US005156278A

United States Patent [19]

Aaron et al.

[11] Patent Number: 5,156,278

[45] Date of Patent: Oct. 20, 1992

[54] PRODUCT DISCRIMINATION SYSTEM AND METHOD THEREFOR

[76] Inventors: James W. Aaron, 13551 View Dr., Orange Cove, Calif. 93646; Gerald R. Richert, 45832C Sierra Dr., Three Rivers, Calif. 93271

[21] Appl. No.: 479,107

[22] Filed: Feb. 13, 1990

[51] Int. Cl.[5] ..... B07C 5/342

[52] U.S. Cl. ..... 209/556; 209/580; 209/586; 209/587; 209/701

[58] Field of Search ..... 209/555, 556, 576, 577, 209/580, 581, 586, 587, 651–654, 698, 701; 356/379, 380

[56] References Cited

U.S. PATENT DOCUMENTS

| | | | |
|---|---|---|---|
| 3,013,661 | 11/1961 | Strubhar | 209/581 |
| 3,370,692 | 2/1968 | Mosterd . | |
| 3,489,278 | 1/1970 | Alexander . | |
| 3,993,899 | 11/1976 | Chapman | 209/639 X |
| 4,033,450 | 7/1977 | Paddock et al. . | |
| 4,106,628 | 8/1978 | Warkentin et al. | 209/556 |
| 4,246,098 | 1/1981 | Conway et al. | 209/582 X |
| 4,308,959 | 1/1982 | Hoover et al. | 209/701 X |
| 4,454,029 | 6/1984 | Codding | 209/581 |
| 4,482,061 | 11/1984 | Leverett | 209/701 X |
| 4,726,898 | 2/1988 | Mills et al. | 209/545 |
| 4,730,719 | 3/1988 | Brown et al. | 198/387 |
| 4,741,042 | 4/1988 | Throop et al. | 209/701 X |
| 4,961,489 | 10/1990 | Warkentin | 209/698 X |
| 5,029,692 | 7/1991 | Warkentin | 198/365 |

FOREIGN PATENT DOCUMENTS

| | | | |
|---|---|---|---|
| 0345036 | 12/1989 | European Pat. Off. . | |
| 0346045 | 12/1989 | European Pat. Off. . | |
| WO89/08510 | 9/1989 | PCT Int'l Appl. | 209/580 |
| 2143491 | 4/1987 | United Kingdom . | |

*Primary Examiner*—Michael S. Huppert
*Assistant Examiner*—Edward M. Wacyra
*Attorney, Agent, or Firm*—Lyon & Lyon

[57] ABSTRACT

A product discrimination system using an off-loading conveyor with rotatably mounted bow tie rollers to convey product units past a sensing station. The sensing station includes four receptors arranged along the conveying path for sensing the physical attributes of products. Between the receptors are friction surfaces which contact the rollers to rotate same and, in turn, rotate the product units on the conveyor. During sensing, the product units are stationary. Ahead of the sensing station, an elongate friction surface is positioned to rotate the rollers. The four views of each product unit may be independently analyzed or may be compared. A ratio of the greatest and the least of the readings may be used to grade product units. The greatest or least may be used independently to grade or may both be discarded and an average taken of the remaining readings to determine an average of an attribute.

26 Claims, 7 Drawing Sheets

FIG. 10
PRIOR ART
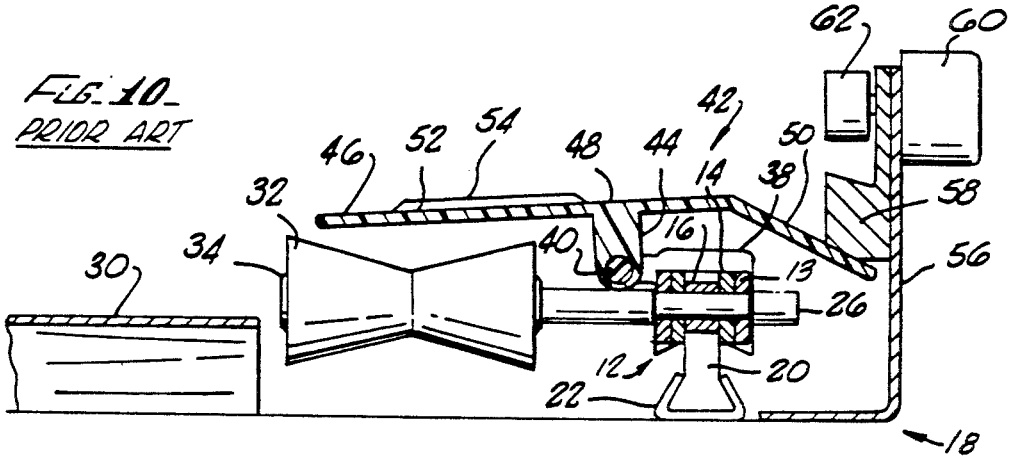
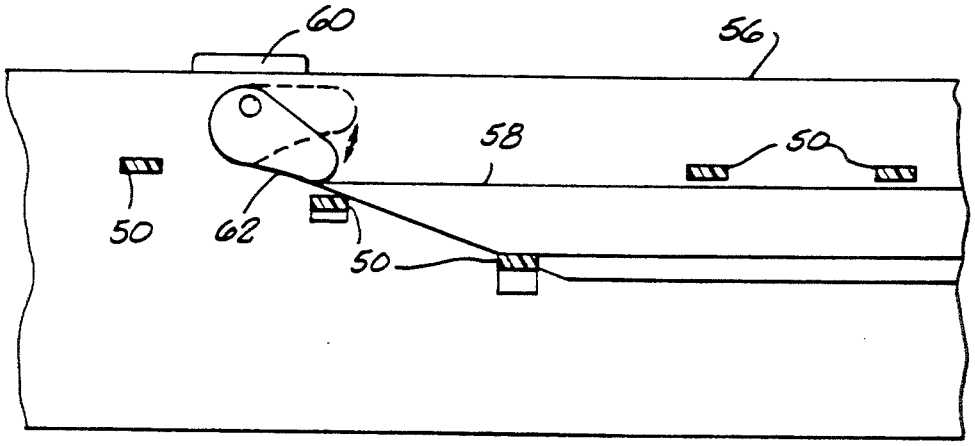
FIG. 11
PRIOR ART

PRODUCT DISCRIMINATION SYSTEM AND METHOD THEREFOR

BACKGROUND OF THE INVENTION

The field of the present invention is product discrimination systems using remote sensing.

Fruit and vegetable products have been subject to sorting based on color in the past. Initially, such tasks were performed manually. More recently, as labor continues to be more and more expensive and unavailable, machine sorting by color has been attempted. A device capable of sorting by color is described in U.S. Pat. No. 4,106,628 to Warkentin et al., the disclosure of which is incorporated herein by reference. In this system, color from a product unit is directed through lenses, fiber optics and filters to a sensing mechanism. In the actual system, light from both sides of a product unit was gathered in a single scan per product unit by two bundles of optic fibers looking from opposite sides of the product unit. Each optic fiber bundle was split and combined with a respective split portion of the other bundle. Therefore, each resulting optic fiber bundle had light from both sides of the product unit. Filters of different wavelength capacity were employed to filter the light derived from the resulting two fiber optic bundles. Red and green filters were given as examples, one filter for each resulting bundle. The signals generated by the filtered light were then compared with a standard such that a red/green color classification could have been made based on the readings compared with the standard.

More complicated sensing devices have been developed which use line scan cameras for determining such attributes as cross-sectional area. Such cameras have used light to present pixel information which may then be processes for summation and the like. For example, cross-sectional area may be determined by counting the number of pixels registering presence of the product unit. In order to detect color using such a system, a central processing unit having substantial capacity would be required because of the significant amount of data to be received and processed. With product units travelling at any reasonable speed past such a discrimination system, it quickly becomes impossible to keep up with the processing of relevant information without a very substantial data processing system. Further, being constrained to pixel units does not afford adequate latitude in controlling sensitivity.

To overcome the excessive amount of data, optical scanning of products using a variety of light spectra both in and beyond the visible spectrum has been attempted with the magnitudes of the sensed light spectra analyzed to determine physical attributes without requiring the analysis and handling of individual pixels.

In such a system, a focused image of a product unit is directed to a fiber optic array. The array has a first end which is arranged in a rectangle. Because of this arrangement, the fiber optic cable receives what approximates a line scan image. The image is averaged and then divided and directed through filters to provide a plurality of sensed signals for different wavelengths. Intensity may be measured for each selected wavelength spectrum. Consequently, only a few signals, the magnitude of each separately filtered portion of the image, need be processed. FIGS. 1 through 6 illustrate such a prior sensing system. FIGS. 2 through 6 further illustrate hardware incorporated into the preferred embodiment herein. Reference is also made to European Patent Application Publication No. 0 346 045 to Richert, the disclosure of which is incorporated herein by reference.

Devices for handling the product units have also been developed. Such processing devices generally include conveyors passing work stations where workers were able to distinguish and separate product units. With the advent of electronics and sophisticated software, conveying systems have required more exacting placement of the product units, separation of those units, proper orientation and reorientation and means for quickly but gently separating the units from the system. The demands for such exacting placement, control and operation are orders of magnitude more stringent than for manual processing.

An early system for handling of products in a manner acceptable for automatic sorting is disclosed in U.S. Pat. No. 4,106,628 to Warkentin et al. In this system, a conveyor was employed which included elements capable of tipping to off-load individual units of a product being processed. The nature of the conveyor permitted some variety in shapes and sizes, including elongated products. However, a range of round or oval products in smaller sizes was not as easily accommodated.

Further off-loading conveyor systems have been developed for handling a wide variety of product including small spherical and ovular shapes and easily damaged units. Product could also be viewed from two sides through the off-loading of product from one conveyor onto another. Reference is made to British Patent 2 143 491 to Warkentin, the disclosure of which is incorporated herein by reference. Bow tie rollers have been mounted to a chain conveyor to define concavities between adjacent rollers. Off-loading elements or paddles have been arranged between rollers to face the concavities. They may be actuated to void the concavity by sweeping therethrough. FIGS. 7 through 15 illustrate such a prior conveying system. These same mechanisms are contemplated for use in the preferred embodiment of the present system. Reference is also made to European Patent Application Publication No. 0 345 036 to Warkentin, the disclosure of which is incorporated herein by reference.

SUMMARY OF THE INVENTION

The present invention is directed to a product discrimination system employing remote sensing of product units conveyed along a conveying path. Both method and apparatus are contemplated.

In a first aspect of the present invention, multiple sensing of the product is accomplished in series with a partial rotation of the product unit between each sensing and with the product stationary during each sensing. The rotation is accomplished by driving the supporting elements on the conveyor. Such rotation and multiple sensing provides substantial capabilities in the accuracy and variety of measurements derived from the process.

In a further object of the present invention, an extended drive is provided for rotation of the supporting elements and, in turn, the product units on the conveyor prior to the sensing operation. Fruit and vegetable product units tend to be nonuniform and difficult to singulate and properly position on a conveyor. The rotation of such product units on the supporting elements tends to allow them to properly orientate, seat in a conveyor cavity and separate one from another such that sensing is enhanced.

In another aspect of the present invention, a ratio of the greatest and least representations of cross-sectional areas, sizes or weights of a product unit as measured by multiple views with rotation of that product unit between views is taken to determine deviations from a spherical shape. Certain products have a tendency to grow in a flat manner rather than spherical. Such growth is considered off-grade. Through multiple readings with rotation, the system has the capability of grading such anomalies.

In yet another aspect of the present invention, great versatility in the calculation of weight is available. With three or more readings, the greatest and least representations of weight (cross-sectional area) can be discarded and the remaining readings averaged. Alternately, the greatest or least measurement can be used where desired.

Accordingly, it is an object of the present invention to provide a discrimination and handling system for accurately sorting product units according to various physical parameters. Other and further objects and advantages will appear hereinafter.

BRIEF DESCRIPTION OF THE DRAWINGS

FIG. 10 is a cross-sectional elevation taken along line 10—10 of FIG. 7.

FIG. 11 is a cross-sectional elevation taken along line 11—11 of FIG. 7.

DETAILED DESCRIPTION OF THE PREFERRED EMBODIMENT

Figure 2:
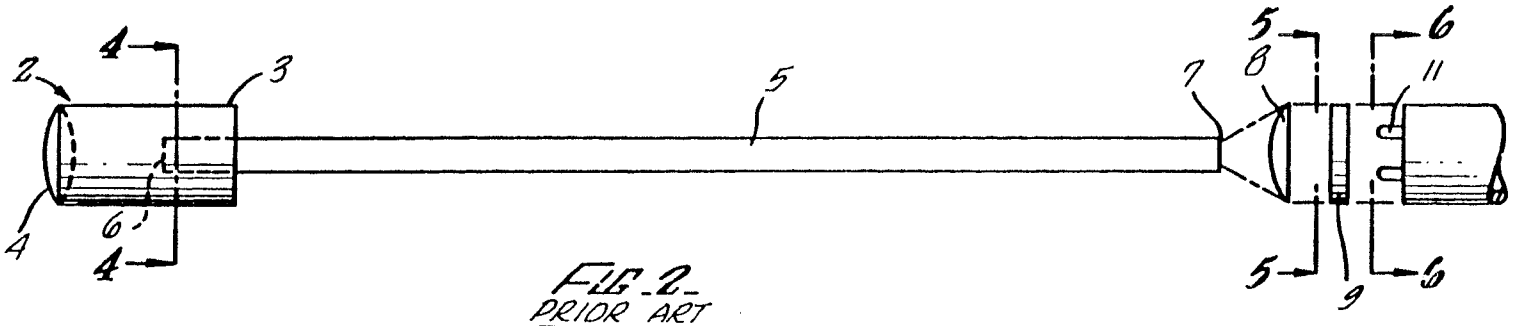
FIG. 2. PRIOR ART
FIG. 2 is a schematic illustration of an optical sensing device employed by the present invention.

A prior product discrimination system is illustrated in FIGS. 1 through 6. The sensing system as illustrated in FIGS. 2 through 6 is contemplated for use in the present preferred embodiment. In the prior system, one or more units of product, or objects 1, to be sensed are brought into appropriate position at a viewing station by a conveying means. The objects 1 may be illuminated as needed for appropriate sensing by conventional lights. Receptors or lens assemblies 2 are positioned to view and sense the electromagnetic energy, or light spectrum, from the objects 1. The lens assemblies 2 are positioned in accordance with the system design.

Looking in greater detail to the optical sensing device contemplated for use in the preferred embodiment herein, each lens assembly 2 includes a housing 3 with a lens 4 positioned at an aperture to the housing 3. The lens 4 is positioned at a specific distance from the path along which product units are to pass. With the single lens 4, a focal plane is thus defined within the housing 3. But for the aperture at which the lens 4 is located, the housing 3 is conveniently closed to prevent extraneous light from entering the housing and projecting on the focal plane.

Extending into the lens assembly 2 is a randomized fiber optic cable 5. Such a cable 5 is made up of a plurality of light transmitting fibers which are randomly bundled such that a pattern of light impinging on one end of the cable 5 will be mixed, or averaged, upon exiting the other end of the cable 5.

Figure 4:
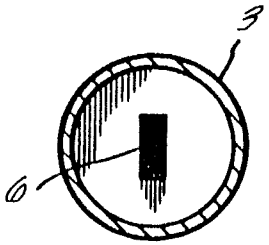
FIG. 4. PRIOR ART
FIG. 4 is a cross-sectional view taken along line 4—4 of FIG. 2.
Figure 6:
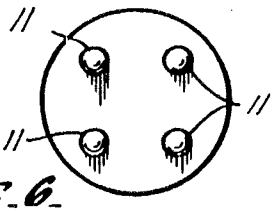
FIG. 6. PRIOR ART
FIG. 6 is a cross-sectional view taken along line 6—6 of FIG. 2.
Figure 3:
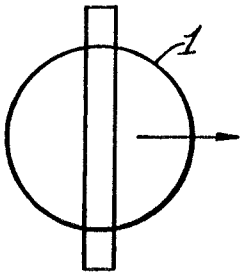
FIG. 3. PRIOR ART
FIG. 3 is a schematic view of the viewing area of the device of FIG. 2.
Figure 5:
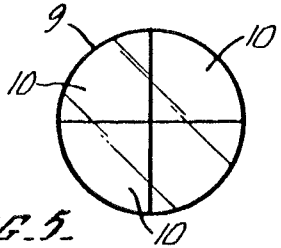
FIG. 5. PRIOR ART
FIG. 5 is a cross-sectional view taken along line 5—5 of FIG. 2.
Figure 1:
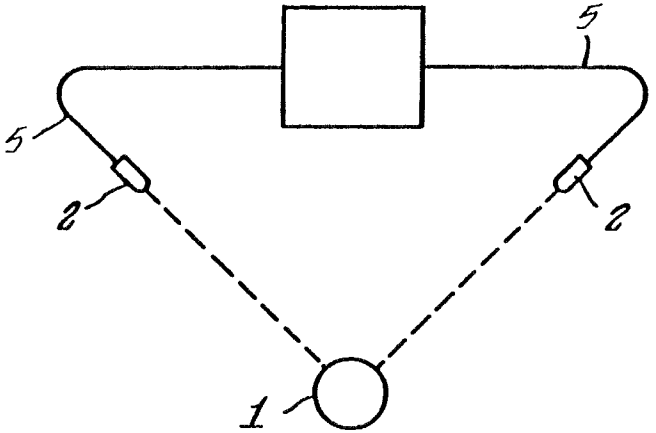
FIG. 1. PRIOR ART
FIG. 1 is a schematic illustration of a discrimination system of the prior art.

The cable 5 has a first end which is positioned at the focal plane of the lens 4. Further, the first end is arranged in a thin rectangular pattern in that focal plane. The pattern of this first end 6 is best illustrated in FIG. 4. The arrangement of the first end 6 in a thin rectangular array at the focal plane of the lens 4 causes the image received by the cable 5 to be a thin rectangular area of the pathway through which product units travel. The image received by the cable 5 is, therefore, like that of a line scan camera. The length of the rectangle transverse to the direction of movement of the product unit is preferably greater than the largest dimension transverse to the conveying path of any anticipated product unit. The width of the rectangular viewing area parallel to the direction of movement is substantially smaller than the dimension along the conveying path of the anticipated product units. Given a constant speed of advancement of each product unit along the conveying path, the discrimination system can be configured such that sequential sensing are made as the product passes by the lens assemblies 2. A complete view of the side of the product unit facing the lens may be achieved by collecting sequential readings from the viewing area as the product moves across that viewing area.

The light energy received by the rectangular first end 6 of the cable 5 is transmitted along the cable to a second end 7. The second end 7 is conveniently circular in the present embodiment. The light transmitted through the cable is averaged and directed against a plano convex lens 8. The lens 8 is positioned such that the second end 7 lies at the focal point of the lens. Thus, the light passing through the lens from the second end 7 of the cable 5 is directed in a substantially nonconverging and nondiverging path. If the second end 7 of the cable 5 is in a circular shape, a similar yet magnified pattern will be transmitted by the lens 8.

Adjacent the lens 8 is a filter assembly 9. The filter assembly 9 may be positioned against or near the lens 8 to receive the light from the cable 5. The filter assembly 9 includes filter elements 10. The filter elements 10 are selected such that the separate elements filter different spectra of light. Thus, the filter assembly may include, for example, a red filter, a green filter, a yellow filter and even a filter outside of the visible spectrum. If the light from the lens 8 is arranged as discussed above, the filter assembly 9 is most conveniently circular with sectors of the circular assembly constituting the filter elements 10. Thus, from a rectangular image of a small slice of the product unit being viewed, a plurality of differently filtered light portions of the averaged light of the image are derived through the filter assembly 9. Four such equal portions are shown in the preferred embodiment. However, other arrangements could well be found beneficial for viewing particular product units.

To receive the divided and filtered portions of light from the original image, photodiodes 11 are presented adjacent the filter elements 10. In the preferred embodiment, one such diode 11 is associated with each filter element sector 10. Thus, an electronic signal is generated by each diode responsive to the magnitude of light conveyed through each of the filter elements.

A prior off-loading conveyor is illustrated in FIGS. 7 through 11 as including an endless roller chain, generally designated 12. The endless roller chain 12 includes links 13 and 14. The links 13 are made up of parallel link elements as are the links 14. The links 14 are found to have the link elements positioned inwardly of the link elements of links 13. The links 13 and 14 are connected end to end by means of rollers 16 in an overlapping arrangement. The links 13 and 14 are free to rotate relative to one another about the rollers 16 to create the appropriate flexibility in a plane perpendicular to the rollers. Centered in each of the links 13 and 14 is a laterally extending hole. The hole is actually found extending in alignment through both link elements of all links 13 and 14 and centered between the rollers 16.

A support structure 18 includes a frame structure with sprocket wheels (not shown) employed to conventionally mount the endless chain 12. A runner 20 is disposed on the upper portion of the support structure to support and guide the endless roller chain. The runner 20 is positioned on a bracket 22 associated with the support structure. This structure defines a conveying path along which the chain 12 moves.

Figure 7:
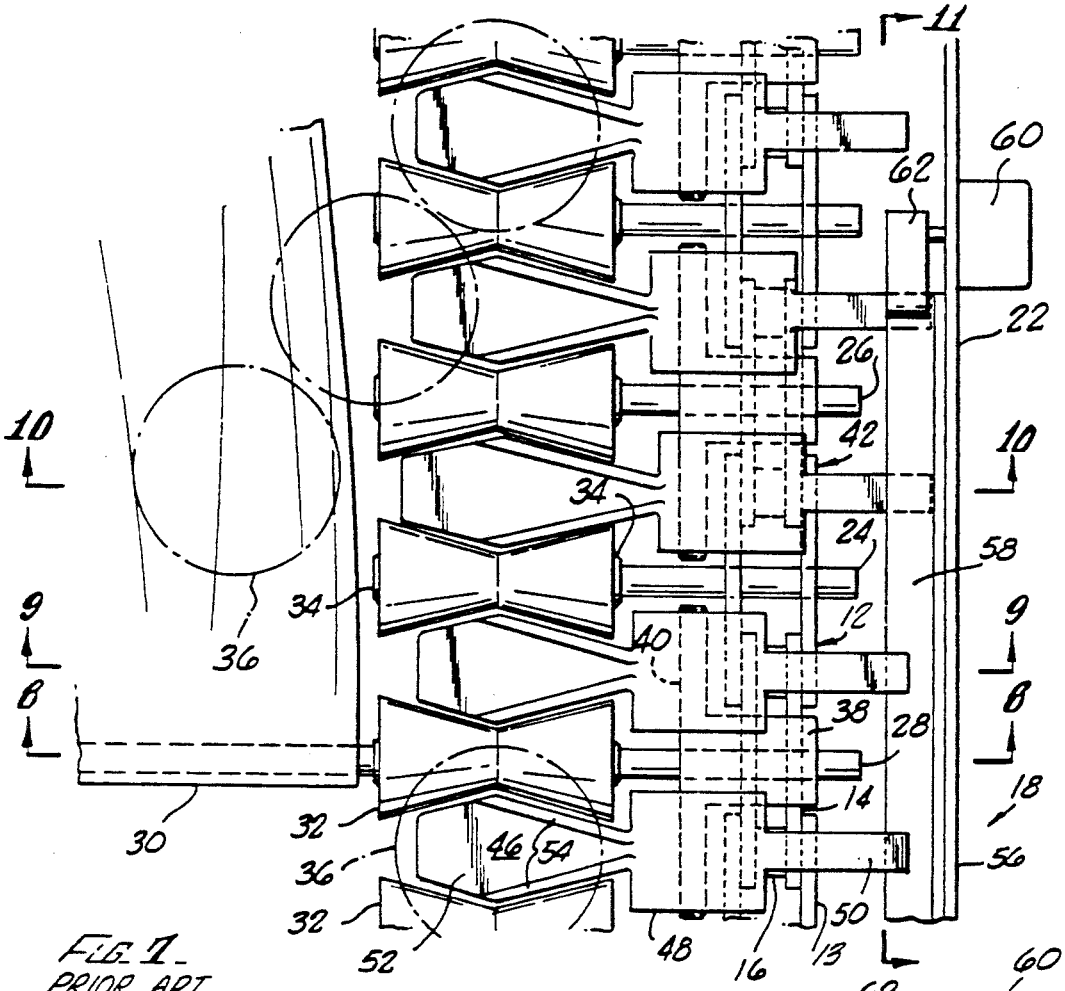
FIG. 7 PRIOR ART
FIG. 7 is a plan view of an off-loading conveyor employed with the present invention.
Figure 8:
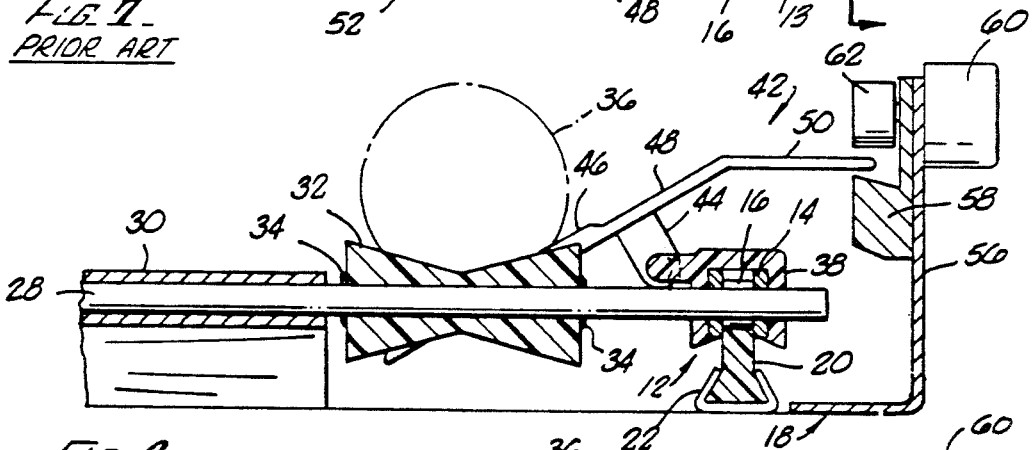
FIG. 8 PRIOR ART
FIG. 8 is a cross-sectional elevation taken along line 8—8 of FIG. 7.
Figure 9:
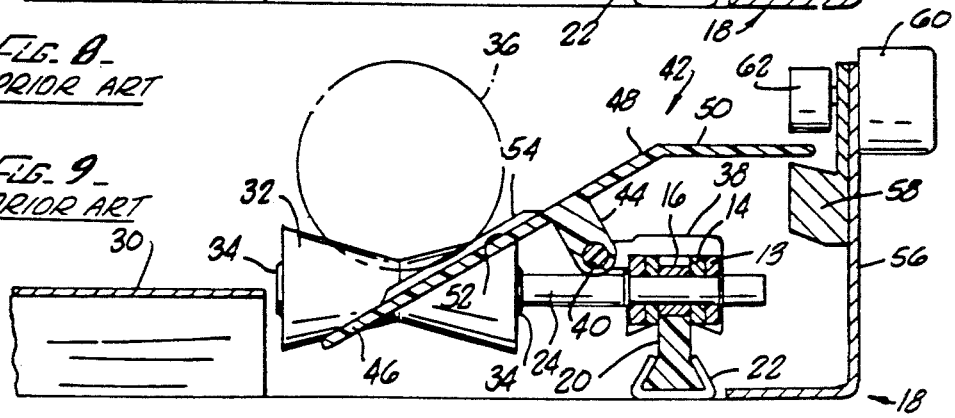
FIG. 9 PRIOR ART
FIG. 9 is a cross-sectional elevation taken along line 9—9 of FIG. 7.
Figure 12:
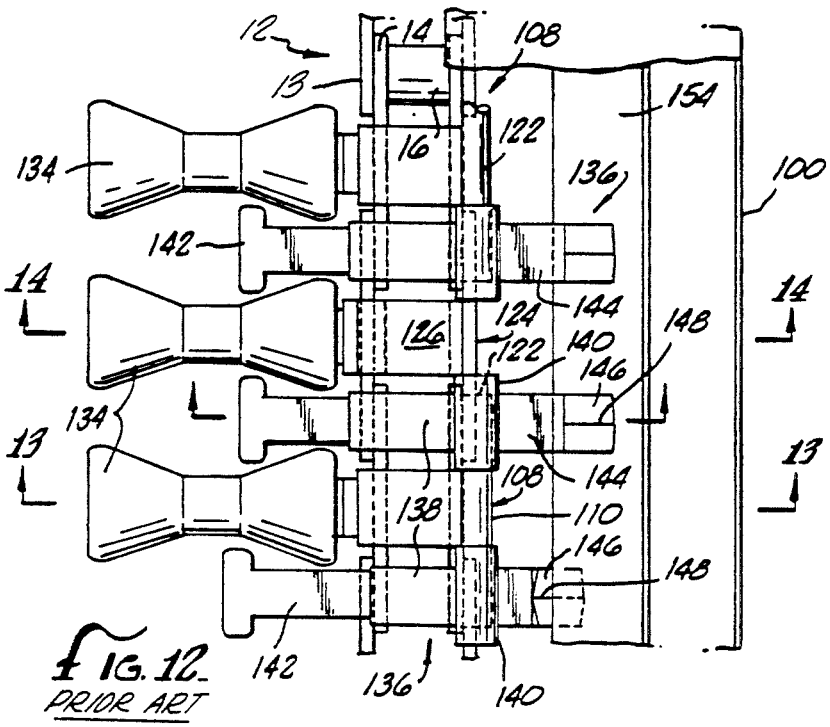
FIG. 12 PRIOR ART
FIG. 12 is a plan view of a second embodiment of an off-loading conveyor used with the present invention.
Figure 13:
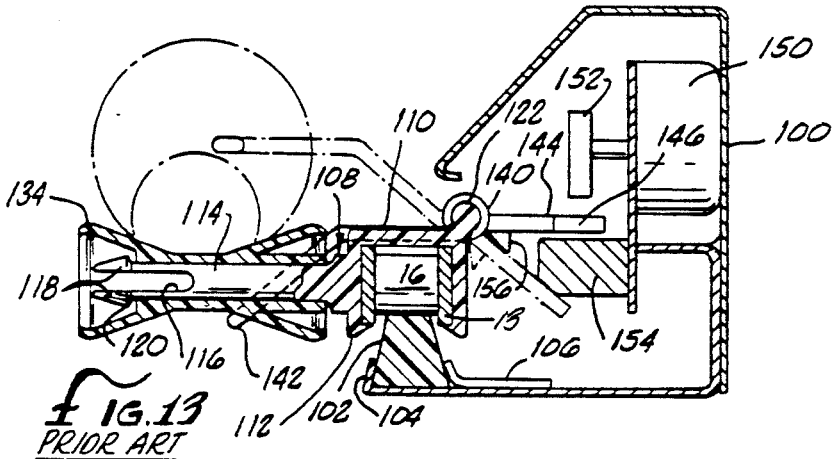
FIG. 13 PRIOR ART
FIG. 13 is a cross-sectional elevation taken along line 13—13 of FIG. 12.

Rods 24 are shown positioned in the holes in the links 13. They are oriented laterally of the endless roller chain 12 and extend laterally outwardly of the roller chain 12 in a first direction (toward the left as seen in FIG. 7). Similarly, rods 26 are positioned in the holes in the links 14 and extend in a similar manner. An extended rod 28 is periodically positioned in place of a rod 26. This rod extends outwardly to receive a curtain 30.

Mounted on each of the rods 24, 26 and 28 is a support element 32. Bow tie shaped elements 32 may be advantageously employed. In the present embodiment, the support elements 32 are bow tie rollers capable of rotating on the rods and being fixed from moving axially along each of the rods by retaining rings 34. The rods thereby provide axes mutually spaced apart for the mounting of the rollers. The support elements 32 include supporting surfaces, in this case defined by two abutting truncated conical members. The bow tie shape is advantageous in that the support surfaces created are inclined downwardly from either end to form a trough extending along the conveying path. This trough may receive elongate products which span roller to roller in what may be considered a first concavity. Each support surface, from its centerline, is also inclined downwardly toward the next support element. Adjacent support elements define, by means of these supporting surfaces, additional concavities for holding units of the product. A unit of the product is schematically illustrated by the phantom lines 36. As the units of product are solid, it is unnecessary to define a complete surface to the concavity. The support surfaces of each support element help define, with the adjacent support element, a sufficient supporting surface to accommodate rounded products.

Clamped to the links 14 are mounts 38. The mounts are U-shaped in structure with a locking flange designed to hook under the bottom of each link. Each mount 38 is conveniently of resilient plastic such that the mounts may be easily snapped in place. Each mount 38 has a pivot pin 40 which extends perpendicular to the orientation of the rods. The pin 40 is shown in this embodiment to extend in both directions from the mount to a width approaching the next adjacent rod 24. A hole extends through the mount so as to be in alignment with the laterally extending hole through the link. In this way, the rod 26 or 28 may be positioned in the link.

Positioned on the pivot pins 40 are off-loading elements 42. The off-loading elements 42 are pivotally mounted to the endless roller chain 12 by means of the mounts 38. Each off-loading element 42 includes a mounting portion 44 having a hole therethrough. The hole receives the pivot pin 40 such that the off-loading element 42 is pivotally mounted to a mount 38. The mounting portion 44 extends upwardly to provide height above the chain 12. Each off-loading element 42 also includes a paddle 46, a base portion 48 and a lever 50. The base portion 48 presents a broad flat section corresponding to the length of the mounting portion 44.

Extending from one end of the base portion 48 is the paddle 46. The paddle extends to pivot through the concavity between adjacent support elements 32. The paddle 46 is inclined downwardly away from the chain 12 to face the concavity in a retracted position. This retracted position can be seen, for example, in FIG. 8. The paddle 46 is laterally displaced from the axis defined by the pin 40 toward the concavity and extends downwardly as well as outwardly away from the pin 40. When the paddle 46 is actuated to pivot outwardly, the downward incline presents a horizontal component of force against the product unit so as to insure movement of the unit laterally from the conveyor. The arrangement of the paddle is such that even with the off-loading element 42 pivoted to a position at the upper extent of the rollers, as seen in FIG. 10, the paddle portion still is inclined downwardly away from the roller chain 12. Further, the paddle 46 extends substantially the whole distance across the concavity. In this embodiment, the paddle is designed to insure off-loading of all product units upon actuation of the paddle 46.

The paddle 46 includes a concave surface facing the concavity between the support elements 32 in the retracted position. This concave surface is defined by a planar surface 52 and two upstanding ribs 54 bordering the planar surface on either side of the paddle 46. The concave surface in the preferred embodiment is arranged to closely fit within the concavity between the support elements 32, in this case the bow tie rollers. Consequently, the surface includes a diverging portion associated with a converging portion as seen moving in a direction away from the chain 12. The diverging portion includes the upstanding ribs 54 at the opposed borders. The converging portion does not include ribs. Product units may then freely move across the converging portion surface and off of the conveyor.

The lever 50 extends away from the base portion in the opposite direction from the paddle in the preferred embodiment. Naturally, this lever 50 may extend in any convenient direction so as to avoid interference with the product units. Through this lever 50, the pivotal orientation of the off-loading element 42 may be controlled so as to allow placement or induce removal of product units from the concavity defined by the support elements 32.

To control the off-loading elements 42 by means of the lever 50, the support structure 18 includes an upstanding mounting member 56. The mounting member 56 supports a ramp 58. The ramp 58 is arranged as can best be seen in FIG. 11. The path of the levers 50 moving with the chain 12 is normally above the ramp. Consequently, the ramp 58 does not cause any operation of the off-loading elements 42 which are allowed to pass over the top thereof. A solenoid 60 is also mounted to the mounting member which includes a rotatable arm 62. The arm 62 pivots as seen in FIG. 11 to interfere with the path of travel of the levers 50 of the off-loading elements 42. When the solenoid arm 62 is caused to rotate downwardly, the lever moves downwardly when encountering the arm 62. The off-loading element 42 associated with this lever 50 is caused to rotate to a certain extent upwardly into the concavity between supporting elements 32. This rotation results in the lever 50 engaging the ramp 58 and being driven downwardly to a fully pivoted position. This fully pivoted position is illustrated in FIG. 10. By this operation, the product unit is displaced from the concavity of the conveyor and off-loaded onto a curtain 30. A plurality of ramps 58 and solenoids 60 with arms 62 may be arranged along the conveyor path to provide a plurality of off-loading stations.

In the operation of this first embodiment, the endless roller chain 12 is driven in a conventional manner by a motor about sprocket wheels. On the upper pass of the chain, it rides along a straight conveying path defined by the runner 20. Product units are deposited on the conveyor such that they become positioned in the concavities between supporting elements 32. A means for sensing size, shape, color or other attribute may then view the product units once placed on the conveyor. The motion of the chain is indexed such that when the sensed product unit reaches the desired place for off-loading, the solenoid 60 is actuated. Actuation of the solenoid 60 causes the arm 62 to rotate into the path of travel of the appropriate lever or levers. This causes the levers to ride downwardly across the underside of the arm 62 and the associated ramp 58. In turn, the off-loading element 42 associated with each actuated lever 50 is pivoted such that the associated paddle or paddles 46 swing upwardly through the conveyor to off-load product units onto the adjacent curtain. The products are softly deposited on the curtain by virtue of its flexibility and softness. The product unit then rolls from the curtain into the appropriate container, shoot, bag or other arrangement. In this way, product units may be separated by appropriate physical attribute.

Turning next to the prior second embodiment illustrated in FIGS. 12 through 15, an off-loading conveyer is again illustrated including the endless roller chain previously designated 12 in association with the first embodiment. The holes referred to as extending through the links 13 and 14 need not be present in this chain. Of course, they may be present but provide no function in this second, preferred embodiment.

A support structure 100 is employed with this second embodiment which includes a general frame structure with sprocket wheels (not shown) employed to conventionally mount the endless chain 12. A runner 102 of low friction plastic material or the like is held in place on the support structure 100 by a flange 104 and a bracket 106. The runner 102 is shown to be a trapezoid in cross section such that the base of the runner 102 is dovetailed into the converging flange 104 and spaced brackets 106. The upper end of the runner 102 is shown to support the chain 12 on the rollers 16. With the conventional sprockets and the runner 102, the chain 12 is constrained to move uniformly along a conveying path thus defined by the support structure 100.

Support elements are mounted to the chain 12 to define the conveying mechanism. These elements include two types of roller mounting brackets. A first type of roller mounting bracket 108 is shown mounted to the links 14. The roller mounting brackets 108 each include a U-shaped mounting base 110 which is forced over the links 14 into a interlocked position. The legs of the mounting base 110 have inwardly extending locking flanges 112 to engage the underside of the links 14 as can best be seen in FIG. 13. As can best be seen in FIG. 12, each mounting base 110 is sufficiently narrow to fit between the links 13 when in position on a link 14. To one side of each mounting base 110 of the roller mounting brackets 108 is a rod 114. The rod 114 is shown in this embodiment to be integrally formed with the mounting base 110. The rod extends laterally from the mounting base 110 in a direction which is perpendicular to the longitudinal direction of the chain. Each rod 114 includes a resilient locking end having a center channel 116 to define two locking fingers 118 with flanges 120 extending outwardly from the barrel of the rod 114. From the flanges 120, the ends are tapered toward one another for easy insertion and difficult retraction of the rod 114 when inserted into a cylindrical hole.

Also forming part of the roller mounting brackets 108 are pivot pins 122 which extend along the conveying path of the chain 12. Each pin 102 is shown to extend in both directions from the mounting base 110. In this embodiment, the pins 122 are located to the other side of the chain from the rods 114 on the mounting base 110. Each mounting base 110, rod 114 and pin 122 is preferably molded of high impact plastic material.

Figure 14:
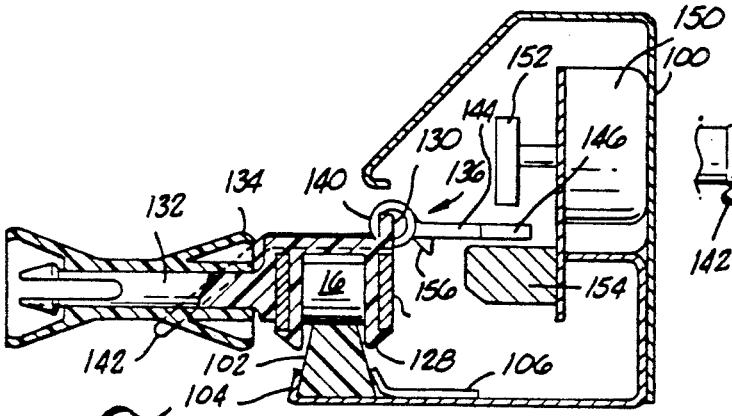
FIG. 14 PRIOR ART
FIG. 14 is a cross-sectional elevation taken along line 14—14 of FIG. 12.
Figure 15:
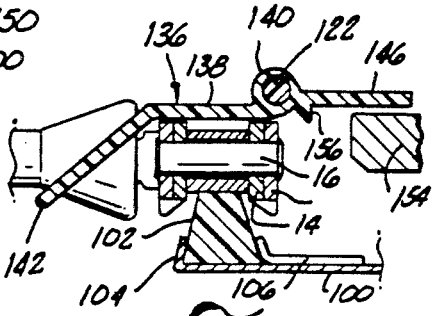
FIG. 15 PRIOR ART
FIG. 15 is a cross-sectional elevation taken along line 15—15 of FIG. 12.

The second type of support elements are fixed to the links 13 between each of the mounting brackets 108. These elements form mounting brackets 124 and also include a mounting base 126. The mounting base 126 is U-shaped and extends to engage the chain. The legs of the base include locking flanges 128 which extend outwardly to engage the links 13. The links 13 are wider than the links 14 and it has been found convenient to provide the roller mounting brackets 108 about the outer side of the narrower links 14 and the roller mounting brackets 124 inwardly of the broader links 13. This second mounting arrangement is best illustrated in FIG. 14. The upper surface of the mounting base 126 includes an upstanding flange 130 in approximate alignment with the pivot pins 122. Extending outwardly from one side of each of the mounting bases 126 is a rod 132. The rods 132 have the same end treatment as each rod 114. Both the rods 114 and 132 may periodically include an extended rod so as to receive a curtain such as curtain 30 illustrated in the first embodiment.

Mounted on the rods 114 and 132 are bow tie shaped elements 134 which are shown here to be rollers preferably rotatable on the rods 114 and 132 but may be fixed in the circumstances where large products are found to span the rollers and move axially along the chain. The bow tie shape is in reference to the upper surface. If the elements do not rotate, they need only have the upper surface as the undersides do not contribute to the formation of concavities useful to receiving product. The rollers 134 define an elongate concavity and concavities between rollers as discussed with regard to the first embodiment.

Arranged to either side of each roller mounting bracket 108 on the extending pivot pins 122 are off-loading elements 136. The off-loading elements 136 include a base portion 138 containing a mounting cylinder 140. The mounting cylinder 140 is sized to fit about an end of one of the pivot pins 122. The mounting cylinder 140 is shown to ride up against the mounting base 110 of the first roller mounting bracket 108. At the other end of the mounting cylinder 140, it comes up against the aligned upstanding flange 130. Thus, the off-loading elements 136 are retained on the pins 122. The off-loading elements 136 each include a paddle 142 extending from the base portion 138. The paddle 142 extends to a retracted position below the concavity defined by the bow tie rollers 134. The paddle 46 is laterally displaced from the axis defined by the pin 40 toward the concavity and extends downwardly as well as outwardly away from the pin 40. In this embodiment, the paddle 142 terminates in a widened portion designed to clear the bow tie roller 134 at the center of the concavity. The pivotal action of the paddle 142 through the concavity from the retracted position is seen in full and phantom in FIG. 13.

The extent of travel of the paddle in this embodiment is shown to sweep through only a portion of the concavity such that product units below a certain size are not positively displaced from the concavity. Consequently, if sufficient kinetic energy is not imparted to the product unit by the paddle 142, the unit will return to a position on the concavity when the paddle is returned to its lower, retracted position. The operation and effect of this arrangement will be discussed further below.

Extending from the base portion 138 in the opposite direction from the paddle 142 is a lever 144. Again, the lever 144 may extend in any convenient direction which does not interfere with the product units. Control of the paddle 142 is accomplished by use of the lever 144. The lever 144 is shown to include a sloped ramp portion 146 rising from either side to a ridge line 148.

Actuation of the off-loading elements 136 is accomplished in a manner substantially the same as with the first embodiment. The support structure 100 is shown to support a solenoid 150 having a rotatable actuator 152. A ramp 154 is arranged in association with the solenoid 150 on the support structure 100 such that the levers 144 will pass therebetween. When the solenoid 150 is actuated, however, the actuator 152 encounters the lever 144 and rotates the lever downwardly to engage the ramp 154. Once the ramp is engaged, movement of the lever 144 with the chain 12 causes the off-loading element 136 to rotate to its fully rotated position to run along the ramp for a predetermined length. The off-loading element 136 is then released to return to its rest position. As the paddle 142 weighs more than the lever 144, the rest position is with the paddle in the lowermost, or retracted, position. A stop 156 limits the rotation of the off-loading element 136 by coming into contact with one side of the mounting base 110.

In the operation of this second embodiment, the basic process of the first embodiment is again realized. Naturally, the size of the bow tie rollers 134, the size and shape of the paddles 142 and the angularity and extent of the ramp 154 all may be designed to accommodate specific product. The angulation of the ramp, as best seen in FIG. 11 in association with the first embodiment, and the speed of the chain 12 determines the acceleration forces placed on product units in removing them from the concavities defined by adjacent bow tie rollers 134. By having the pivot axes of the off-loading elements 136 displaced laterally a substantial extend from the surfaces of the paddles 142 as shown in this embodiment and/or by having the paddles extend only partially through the concavities when pivoted, the paddles tend to roll the products from the concavities rather than throw them. This action is most beneficial with easily damaged product.

Through adjustment by empirical testing, an arrangement with chain speed and ramp angle can be achieved with this second embodiment, where the paddles do not extend across the concavity, such that overly ripe product units will absorb a sufficient amount of the paddle energy that these products will not move fast enough, or have sufficient energy, to be discharged from the conveyor. At the same time, harder units would be moved from the conveyor by translating paddle motion into sufficient kinetic energy to lift the product clear. Thus, in addition to the employment of some sensing mechanism to move product units from the conveyor at selected positions, the physical properties of the product units themselves may also result in programed separation.

Peripheral devices and processes known in the industry are intended to be incorporated with the present system. A guide mechanism 158 is shown as part of the support structure 100 to define the lateral extent of the conveying path. Similar guide mechanisms may be employed as needed on the other side of the conveyor as well. Feeding to the conveyor may be accomplished by a plurality of mechanisms. One such mechanism is to employ a flume of water defined by a narrowing channel. As the channel narrows, the product units may be singulated and sped up to the approximate velocity of the conveyor. The flume may then simply discharge onto the top of the conveyor such that product units are gently placed thereon for processing.

The curtain system as provided by the curtains 30 is but one mechanism for handling off-loaded product units. Simple slots or guide ways may be provided with or without the curtain members. Selected units discriminated by size, color or other physical attribute may be off-loaded at any particular station in conjunction with a ramp 58 or 154. Naturally, one of the off-loading stations can simply be the end of the chain conveyor where the chain proceeds around the sprocket.

Figure 16:
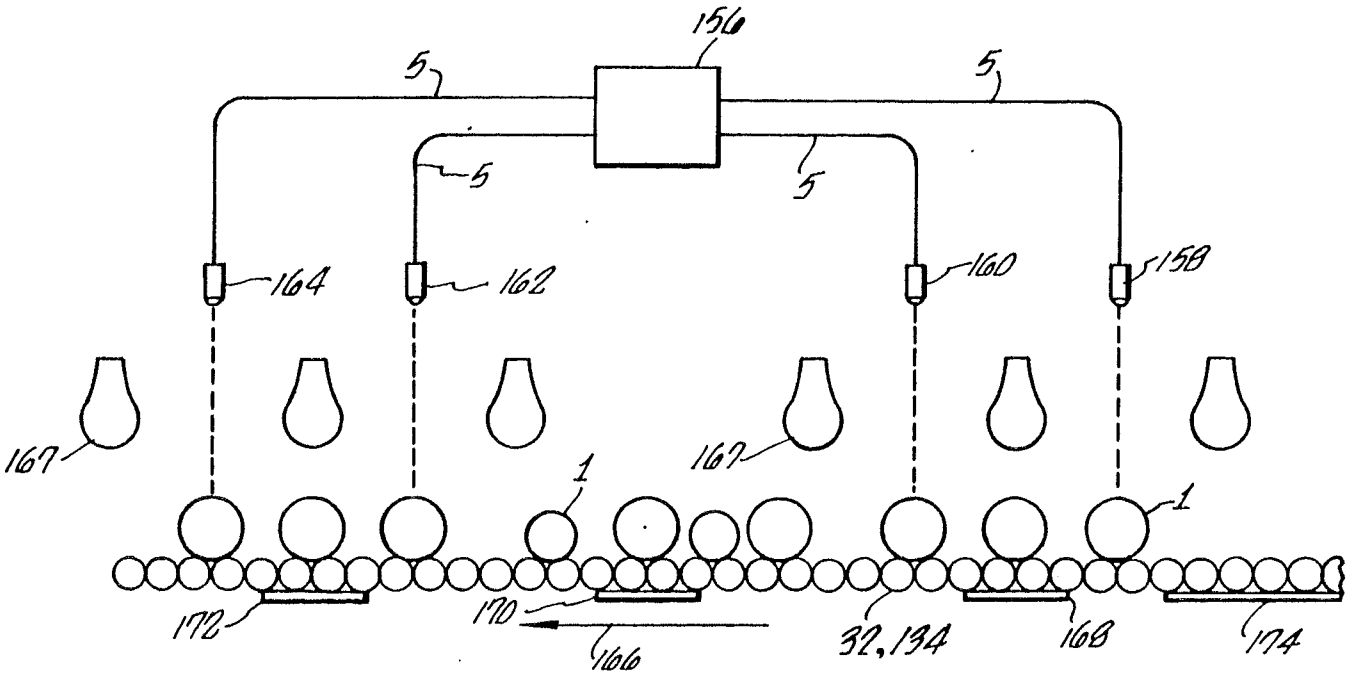
FIG. 16 is a schematic elevation view of the sensor layout of the present invention.
Figure 17:
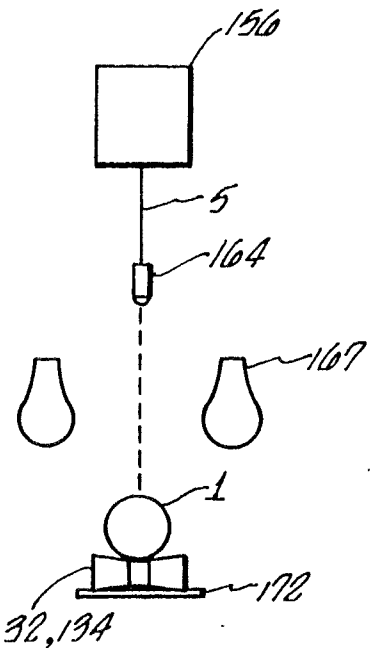
FIG. 17 is a schematic plan view of the sensor layout of FIG. 16.

Turning to the sensing area, FIGS. 16 and 17 illustrate the layout of the present system. A central processing unit 156 is shown to be associated with the fiber optic cables 5 and in turn the receptors 2, separately designated 158, 160, 162 and 164. Four such cables 5 and receptors are coupled with the unit 156. The receptors 158–164 are located directly above the concavities defined by the rollers 32, 134 of the conveyor. This also places the receptors directly above the product units 1 which are conveyed along the conveying path. The conveyor moves in the direction of arrow 166. Thus, the product units 1 conveyed along the conveying path are viewed by the receptors 158, 160, 162 and 164 in seriatim. Lights 167 illuminate the sensing areas.

Figure 18:
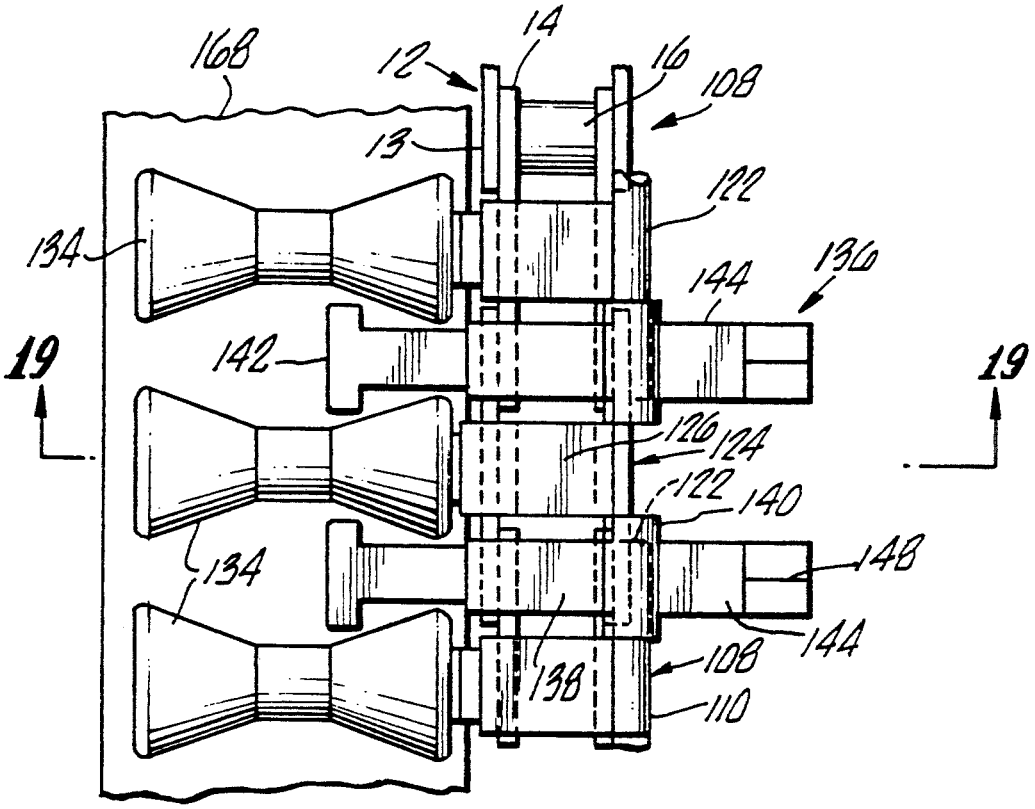
FIG. 18 PRIOR ART
FIG. 18 is a plan view of a conveyor illustrating the roller drive mechanism.
Figure 19:
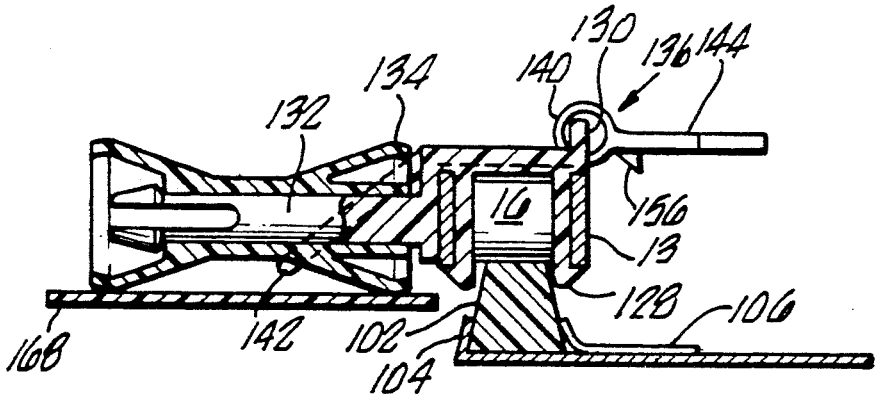
FIG. 19 PRIOR ART
FIG. 19 is a cross-sectional elevation of a conveyor illustrating the roller drive mechanism.

Between each receptor, a drive is positioned to rotate the rollers 32, 134 and in turn the product units 1 positioned thereon. There are three drives 168, 170 and 172 so positioned. With the rollers 32, 134 rotatable, a roughened strip or runner may be employed as the drive to come into contact with the underside of the rollers 32, 134 for a specified length along the conveyor path. Such an arrangement is best illustrated in FIGS. 18 and 19. The use of such runners allows the product to be rotated a specified amount on the conveyor. The drives are selected to extend for a sufficient finite distance such that the product units 1 located thereon are rotated approximately 90°. Naturally, the size and shapes of the product units 1 have a bearing on the degree of rotation. For smaller diameter products, a rotation of approximately 120° would occur. The contact between the runners 168, 170 and 172 and the rollers 32, 134 is empirically determined to be sufficient to prevent slippage therebetween.

The spacing of the drives and the receptors are such that the product units are not rotating at the time of the sensing by the receptors. In the preferred embodiment, the receptors are on 9" centers with the rollers being mutually spaced on 1½" centers and the runners being 4" in length and positioned equidistant between the receptors. By not rotating during observation, sensing of a specific surface and cross section is achieved. Rotation of the product units through significantly less than 180° between observations provides for observation of substantially all of the surface of the product unit without relying on views of the limb areas where the surface is foreshortened to the receptor. Four rotations to achieve a complete revolution of a product unit have been found to be most advantageous without overburdening the system with diminishing returns.

Located before the first receptor is an extended drive 174 for rotation of the rollers 32, 134. This extended drive in the preferred embodiment is 4' where the drives 168, 170 and 172 are 4". The extended drive 174 assists in the distribution of the product units on the conveyor. It has been found that this rotation of the product units through several revolutions assists in the singulation of the units and better orientation for reading. Again, the drive stops before the first receptor in order that the product units are not rotating when being observed.

The processing of the observed magnitudes into useful information is accomplished in the central processing unit 156. The magnitude of each filtered portion may be compared against a standard stored in the data processing unit, converted by a factor or factors developed from prior comparisons with standard samples or tests or normalized through the use of ratios between filtered portions. The accumulated segments or views making up an image formed by sequential images of the entire unit may also be processed in like manner. The standards within the processor for forming a basis for data conversion can be derived from sample product units having known physical attributes. Thus a pattern of magnitudes from the separate filtered portions or accumulation of portions for an entire unit can be compared with standards or converted for cross-sectional size, blemishes, ripeness and color. An indexing of the unit is also processed to fix the product unit on the conveying system. The processing unit may then time the diversion of each product unit according to its physical attribute or attributes to predetermined off-loading stations on the conveying system.

Figure 20:
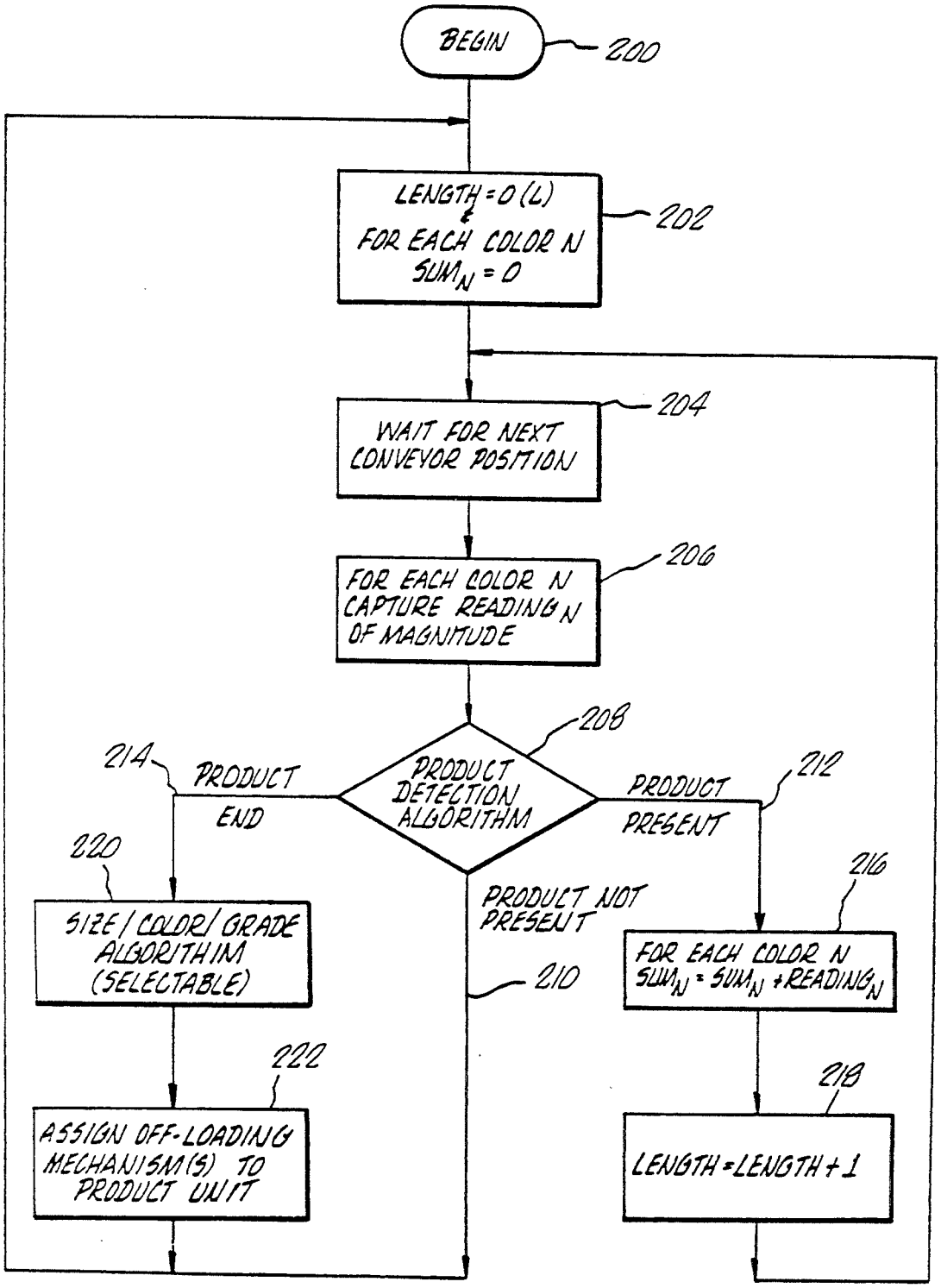
FIG. 20 is a logic flow chart for analysis of the sensed information.

FIG. 20 schematically illustrates analysis of the sensed light received by the photodiodes 11. Step 200 initiates the program. Step 202 initializes the sensed values, i.e., the product length and the magnitude of the light spectra separately sensed.

By step 202, the product length is set to zero. Product length is the length of the product in the direction of motion of the conveyor regardless of the product orientation. For example, what might normally be thought of as the product length may be lying crosswise to the conveyor and hence become its width as recognized by the system for purposes of discrimination. The length is measured in units of movement of the conveyor by a conventional indexing mechanism.

The summation of light magnitudes perceived by the photodiodes 11 is also set to zero. With multiple diodes 11, a plurality of light magnitudes are stored in separate sums. In the present example, four such magnitude summations are processed by the system.

Step 204 times the measurement of light magnitude to coincide with the presentation of a new unit length of product. This step is controlled by the indexing mechanism for the conveyor. By viewing sequential units or slices of the product as it passes through the station, a line scan process is approximated. However, the light received is averaged and individual units of the line scan, or pixels, do not exist. Thus, the useful attribute received is spectra magnitude.

Step 206 stores the magnitude of each light spectra sensed as the successive unit length passes through the viewing station. This storage of magnitude is controlled by step 204 such that an area which is one unit in length and the actual dimension of the product transverse to the direction of motion of the conveyor is sensed. The magnitudes of the selected light spectra ar sensed by the photodiodes 11 and stored by this step.

Step 208 detects whether or not a product unit is present and whether or not the product unit just ceased to be present at the sensing station. If no product is sensed and no product was sensed in the just prior view, the no product logic path 210 is selected. Under this circumstance, logic step 202 is again initiated. If a product is sensed as being present, the product present logic path 212 is followed. If a product unit is not sensed but the just prior view did sense a product unit, the product end logic path 214 is followed.

In the product present logic path 212 when a product is sensed, the magnitude of each light spectra is added to any prior sum of such magnitudes in logic step 216. When the first sensing of a product unit passing through the viewing station occurs, the sum is zero from logic step 202. In successive views, each reading is added to the cumulative sum of magnitudes. The length is also summed in a similar manner with each sensed view being added to the prior length in step 218. Logic step 204 is then instituted to time the next reading.

The product end logic path 214 represents the conclusion of the sensing process on a product unit. In this path, logic step 220 allows the selection of an algorithm for calculating one or more of a plurality of physical attributes. Such attributes might include color, size of the product and product grade. In the case of size, the average color magnitude in association with the product length may give a sufficient approximation of cross-sectional area that the size or weight of the product unit might be determined. Under such circumstances, the readings might be used directly to provide discrimination or might be first converted into conventional units such as weight or volume through a comparison of the sensed values with a standard. Such a comparison might be undertaken with a constant factor, a table or other conventional means by which a standard is integrated into the interpretation of measured data.

Step 220 may also make use of the several readings per product unit in combination as well individually. In the case of size or weight, the representations of area for each product unit may be compared. A ratio of the greatest and the least representations may be calculated and compared to a standard. Where the ratio deviates beyond a specified standard from unity, an override signal may relegate the product unit to an off size or grade station along the conveyor. The greatest and the least representations may be discarded from the calculation and the remaining measurements averaged for a determination of size or weight. The foregoing two calculations could be used in combination to both sort product units by weight and discard misshapen product units regardless of weight. Other selections could be made. The product units could be sorted by either the greatest or the least measurement. Particular anomalies could be recognized as indicating defects.

Once the product unit is categorized, a station is selected to off-load the unit at step 222. Once having resolved the nature of the product and assigned an off-loading station, the program is returned to initialize the summations of light spectra magnitude and length at zero.

The recognition of the physical attribute of the product may result in a binary output or present specific magnitudes. In the case of a binary output, the product may be either retained or rejected at a given station through an on or off signal to an actuator employed to remove products from a conveyor. As an example, heavily blemished product units or unusually large or small product units might be automatically off-loaded from the conveying system at an appropriate off-loading station. Further processing of sensed magnitudes on the other hand might be employed, for example, in selecting from a plurality of off-loading stations to achieve a specific load at each station. Through such a scheme, the estimated weight of individual units could be calculated and units selectively off-loaded at a plurality of stations to achieve a certain bag weight at each station. The signals generated by the system typically may actuate solenoid devices which in turn actuate off-loading systems. Naturally, the indexing mechanism associated with the conveyor is required to present input to the logic system such that the logic system can determine when a given product unit reaches an off-loading station and time the off-loading of the product unit.

Thus, a system is contemplated for inputting light images of product units or portions thereof in an arrangement such that the output presents a plurality of measurable magnitudes of light in specified spectra useful for distinguishing between product units. Multiple such readings are made and used together or compared to achieve enhanced accuracy or further results and system flexibility. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A method for selected discrimination of product units comprising the steps of conveying product units along a conveying path;

sensing one or more of the physical attributes of a product unit including measuring a representation of area four times;

rotating the product unit between each said step of sensing;

allowing the product unit to stop rotating before each said step of sensing;

selecting the greatest and least area representations from said sensing steps;

calculating a ratio of the selected areas;

comparing the ratio with a standard.

2. The method of claim 1 wherein said steps of sensing each include repeatedly measuring in a thin scan area extending across the conveying path the physical attributes of the product unit conveyed along the conveying path, said repeated measuring covering substantially contiguous areas of the product unit.

3. The method of claim 1 further comprising the step of discarding product units having a ratio which differs from the standard by a predetermined amount.

4. The method of claim 1 further comprising the step of rotating the product unit a plurality of complete revolutions before said steps of sensing.

5. The method of claim 1 further comprising the step of selecting an extreme representation of physical attribute of the four representations of the product unit from said steps of sensing four times;

comparing the selected extreme representation with a standard;

categorizing the product unit according to the comparison of the selected extreme representation with a standard.

6. The method of claim 5 wherein said step of selecting the selected extreme representation includes selecting the greatest representation.

7. The method of claim 1 wherein each said step of rotating includes rotating the product unit approximately 90°.

8. A method for selected discrimination of product units comprising the steps of conveying product units along a conveying path;

sensing one or more of the physical attributes of a product unit four times;

rotating the product unit between each said step of sensing;

allowing the product unit to stop rotating before each said step of sensing;

selecting the two middle values of the one or more of the physical attributes sensed from said sensing steps;

calculating the average of the selected values;

categorizing the product unit according to the average calculated.

9. The method of claim 8 further comprising the step of off-loading product units according to the category of each product unit.

10. The method of claim 8 wherein said step of sensing one or more of the physical attributes of a product unit four times includes sensing a representation of cross sectional area and said step of selecting the two middle values includes selecting the two middle values of cross sectional area representation.

11. A method for selected discrimination of product units comprising the steps of conveying product units along a conveying path;

sensing one or more of the physical attributes including a representation of area of a product unit multiple times, each said step of sensing including repeatedly measuring in a thin scan area extending across the conveying path the physical attributes of the product unit conveyed along the conveying path, said repeated measuring covering substantially contiguous areas of the product unit;

rotating the product unit between each said step of sensing;

allowing the product unit to stop rotating before each said step of sensing selecting the greatest and least area representations from said sensing steps;

taking a ratio of the selected areas;

comparing the ratio with a standard.

12. The method of claim 11 further comprising the step of discarding product units having a ratio which differs from the standard by a predetermined amount.

13. A method for selected discrimination of product units comprising the steps of conveying product units along a conveying path;

sensing one or more of the physical attributes of a product unit multiple times, each said step of sensing including repeatedly measuring in a thin scan area extending across the conveying path the physical attributes of the product unit conveyed along the conveying path, said repeated measuring covering substantially contiguous areas of the product unit;

rotating the product unit between each said step of sensing;

allowing the product unit to stop rotating before each said step of sensing;

discarding the greatest and least values of the one or more of the physical attributes sensed from said sensing steps;

calculating the average of the remaining values of the one or more of the physical attributes sensed;

categorizing the product unit according to the average calculated.

14. The method of claim 13 further comprising the step of off-loading product units according to the category of each product unit.

15. The method of claim 9 wherein said step of sensing one or more of the physical attributes of a product unit four times includes sensing a representation of cross sectional area and said step of selecting the two middle values includes selecting the two middle values of cross sectional area representation.

16. A method for selected discrimination of product units comprising the steps of conveying product units along a conveying path;

sensing one or more of the physical attributes of a product unit multiple times including measuring a representation of area;

rotating the product unit between each said step of sensing;

allowing the product unit to stop rotating before each said step of sensing;

selecting the greatest and least area representations from said sensing steps;

taking a ratio of the selected areas;

comparing the ratio with a standard.

17. The method of claim 16 further comprising the step of discarding product units having a ratio which differs from the standard by a predetermined amount.

18. The method of claim 16 further comprising the step of rotating the product unit a plurality of complete revolutions before said steps of sensing.

19. The method of claim 16 further comprising the step of selecting an extreme representation of physical attribute of the multiple representations of the product unit from said steps of sensing multiple times;

comparing the selected extreme representation with a standard;

categorizing the product unit according to the comparison of the extreme representation with a standard.

20. The method of claim 19 wherein said step of selecting includes selecting the greatest representation.

21. The method of claim 16 wherein each said step of rotating includes rotating the product unit approximately 90°.

22. A method for selected discrimination of product units comprising the steps of conveying product units along a conveying path;

sensing one or more of the physical attributes of a product unit multiple times including measuring a representation of area, each said step of sensing including repeatedly measuring in a thin scan area extending across the conveying path the physical attributes of the product unit conveyed along the conveying path, said repeated measuring covering substantially contiguous areas of the product unit;

rotating the product unit between each said step of sensing;

allowing the product unit to stop rotating before each said step of sensing;

discarding the greatest and least area representations from said sensing steps;

calculating the average of the remaining area representations;

categorizing the product unit according to the average calculated.

23. The method of claim 22 further comprising the step of off-loading product unit according to the category of each product unit.

24. A method for selected discrimination of product units comprising the steps of conveying product units along a conveying path;

sensing one or more of the physical attributes of a product unit four times to obtain four representations of each physical attribute sensed;

rotating the product unit between each said step of sensing;

allowing the product unit to stop rotating before each said step of sensing;

selecting the two middle representations of each physical attribute from said sensing step;

calculating the average of the selected representations of each physical attribute;

categorizing the product unit according to the average calculated.

25. The method of claim 24 wherein said step of sensing one or more of the physical attributes of a product unit four times includes sensing a representation of cross sectional area and said step of selecting the two middle values includes selecting the two middle values of cross sectional area representation.

26. A method for selected discrimination of product units comprising the steps of conveying product units along a conveying path;

sensing one or more of the physical attributes of a product unit including measuring a representation of area four times, each measurement including repeatedly measuring in a thin scan area extending across the conveying path the physical attributes of the product unit conveyed along the conveying path, said repeated measuring covering substantially contiguous areas of the product unit, and receiving light from the thin scan area, averaging the light received, dividing the light into spectra, recording magnitudes of specified spectra indicative of the physical attributes;

rotating the product unit between each said step of sensing;

allowing the product unit to stop rotating before each said step of sensing;

selecting the greatest and least area representations from said sensing step;

calculating a ratio of the selected area;

comparing the ratio with a standard.

* * * * *

UNITED STATES PATENT AND TRADEMARK OFFICE

CERTIFICATE OF CORRECTION

PATENT NO. : 5,156,278
DATED : October 20, 1992
INVENTOR(S) : Aaron J. Warkentin, et. al.

It is certified that error appears in the above-indentified patent and that said Letters Patent is hereby corrected as shown below:

On the Title page, item [19], delete "Aaron et al." and insert therefor-- Warkentin et al.--.

On the Title page, item [76] Inventors: delete "james W. Aaron" and insert therefor -- Aaron J. Warkentin --.

Signed and Sealed this

Thirtieth Day of November, 1993

Bruce Lehman

*Attest:*

BRUCE LEHMAN

*Attesting Officer*

*Commissioner of Patents and Trademarks*